US010994171B2

(12) United States Patent
Nolan

(10) Patent No.: US 10,994,171 B2
(45) Date of Patent: May 4, 2021

(54) EXERCISE MACHINE AND METHOD OF USE

(71) Applicant: Nicole Nolan, Houston, TX (US)

(72) Inventor: Nicole Nolan, Houston, TX (US)

( * ) Notice: Subject to any disclaimer, the term of this patent is extended or adjusted under 35 U.S.C. 154(b) by 16 days.

(21) Appl. No.: 16/437,578

(22) Filed: Jun. 11, 2019

(65) Prior Publication Data

US 2019/0374807 A1 Dec. 12, 2019

Related U.S. Application Data

(60) Provisional application No. 62/683,069, filed on Jun. 11, 2018.

(51) Int. Cl.

| | |
|---|---|
| ***A63B 21/00*** | (2006.01) |
| ***A63B 21/06*** | (2006.01) |
| ***A63B 23/035*** | (2006.01) |
| ***A63B 23/12*** | (2006.01) |

(52) U.S. Cl.

CPC ..... *A63B 21/159* (2013.01); *A63B 21/00072* (2013.01); *A63B 21/0615* (2013.01); *A63B 21/4011* (2015.10); *A63B 21/4029* (2015.10); *A63B 21/4035* (2015.10); *A63B 23/03525* (2013.01); *A63B 23/12* (2013.01); *A63B 2208/0257* (2013.01)

(58) Field of Classification Search

CPC ..... A63B 21/06; A63B 21/0615–0617; A63B 21/08; A63B 21/159; A63B 21/4047

See application file for complete search history.

(56) References Cited

U.S. PATENT DOCUMENTS

| | | | | |
|---|---|---|---|---|
| 4,266,766 | A * | 5/1981 | Calderone | A63B 21/0615 482/137 |
| 4,344,619 | A * | 8/1982 | Szabo | A63B 21/0615 248/161 |
| 4,923,195 | A * | 5/1990 | Calderone | A63B 21/0615 482/97 |
| 5,358,462 | A * | 10/1994 | Calderone | A63B 21/0615 482/102 |
| 5,769,757 | A * | 6/1998 | Fulks | A63B 21/0615 482/137 |
| 6,358,189 | B1 * | 3/2002 | Koenig | A63B 21/0615 482/136 |
| 6,500,106 | B1 * | 12/2002 | Fulks | A63B 21/0615 482/137 |
| 7,530,936 | B1 * | 5/2009 | Hall | A63B 21/0615 482/137 |
| 9,849,328 | B1 * | 12/2017 | Fulks | A61H 1/0266 |

(Continued)

*Primary Examiner* — Jennifer Robertson

(74) *Attorney, Agent, or Firm* — Richard Eldredge; Eldredge Law Firm

(57) ABSTRACT

An exercise machine system includes a frame having a front bar and a back bar with a cross bar extending therebetween; a weight attachment bar pivotally attached to the cross bar, the weight attachment bar extending to a weight end; one or more handles attached to the weight bar and configured to provide a gripping location to provide upward movement of the weight bar; and a body support positioned above the frame, the body support having one or more pads to allow for supporting a person thereon; the weight attachment bar is positioned under the body support such that a user can pull up on the weight attachment bar from the body support.

2 Claims, 4 Drawing Sheets

(56) References Cited

U.S. PATENT DOCUMENTS

| | | | | |
|---|---|---|---|---|
| 10,639,518 | B2 * | 5/2020 | Fulks | A63B 21/0615 |
| 2009/0118104 | A1 * | 5/2009 | Chou | A63B 21/0615<br>482/94 |
| 2014/0256516 | A1 * | 9/2014 | Calderone | A63B 23/03525<br>482/98 |
| 2017/0087402 | A1 * | 3/2017 | Chen | A63B 21/0615 |

* cited by examiner

EXERCISE MACHINE AND METHOD OF USE

BACKGROUND

1. Field of the Invention

The present invention relates generally to exercise machine systems, and more specifically, to an exercise machine system that allows for multiple exercises to be completed on one machine.

2. Description of Related Art

Exercise systems are well known in the art and are effective means to increase physical fitness. For example, FIG. 1 depicts a flowchart 101 of a conventional method. In some situations, a user will travel to the gym, wherein they will use a plurality of machines for a plurality of exercises, as shown with boxes 103, 105, 107, 109, This process is time consuming and inefficient.

As will be described herein, the present invention relates to a system that allows for completion of a plurality of exercises on one machine, thereby saving time and space for the user. The user further does not have to utilize multiple pieces of equipment for a plurality of exerciss.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
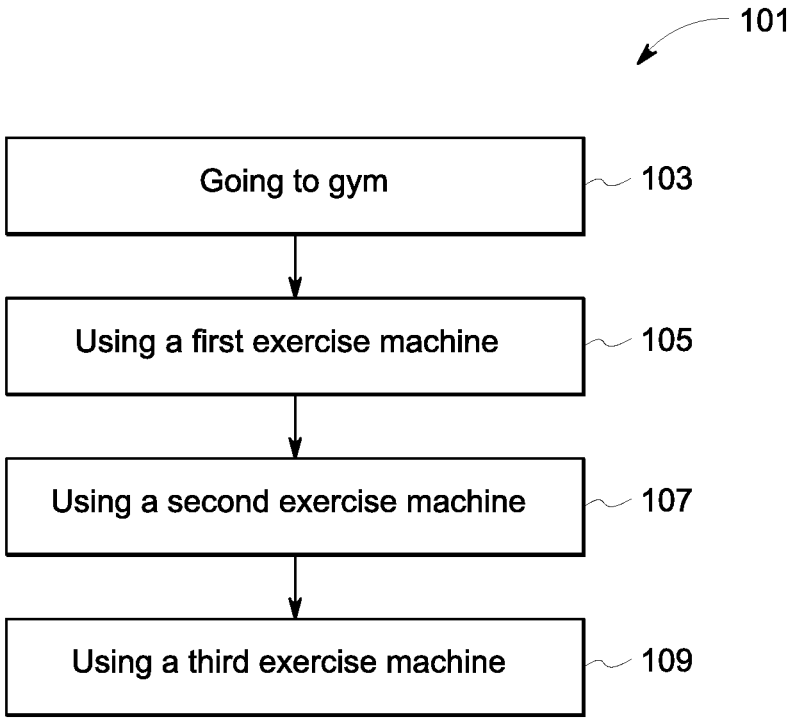
(PRIOR ART) FIG. 1
FIG. 1 is a flowchart of a conventional exercise system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional exercise machine systems. Specifically, the present invention provides for a machine that includes a plurality of functions, namely the ability to be used for one or more of the following: hyper extension, chest supported T-bar rows, bent over chest supported T-bar rows, chest supported barbell rows, bent over chest supported barbell rows, chest supported dumbbell rows, bent over chest supported dumb bell rows, and seal rows. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
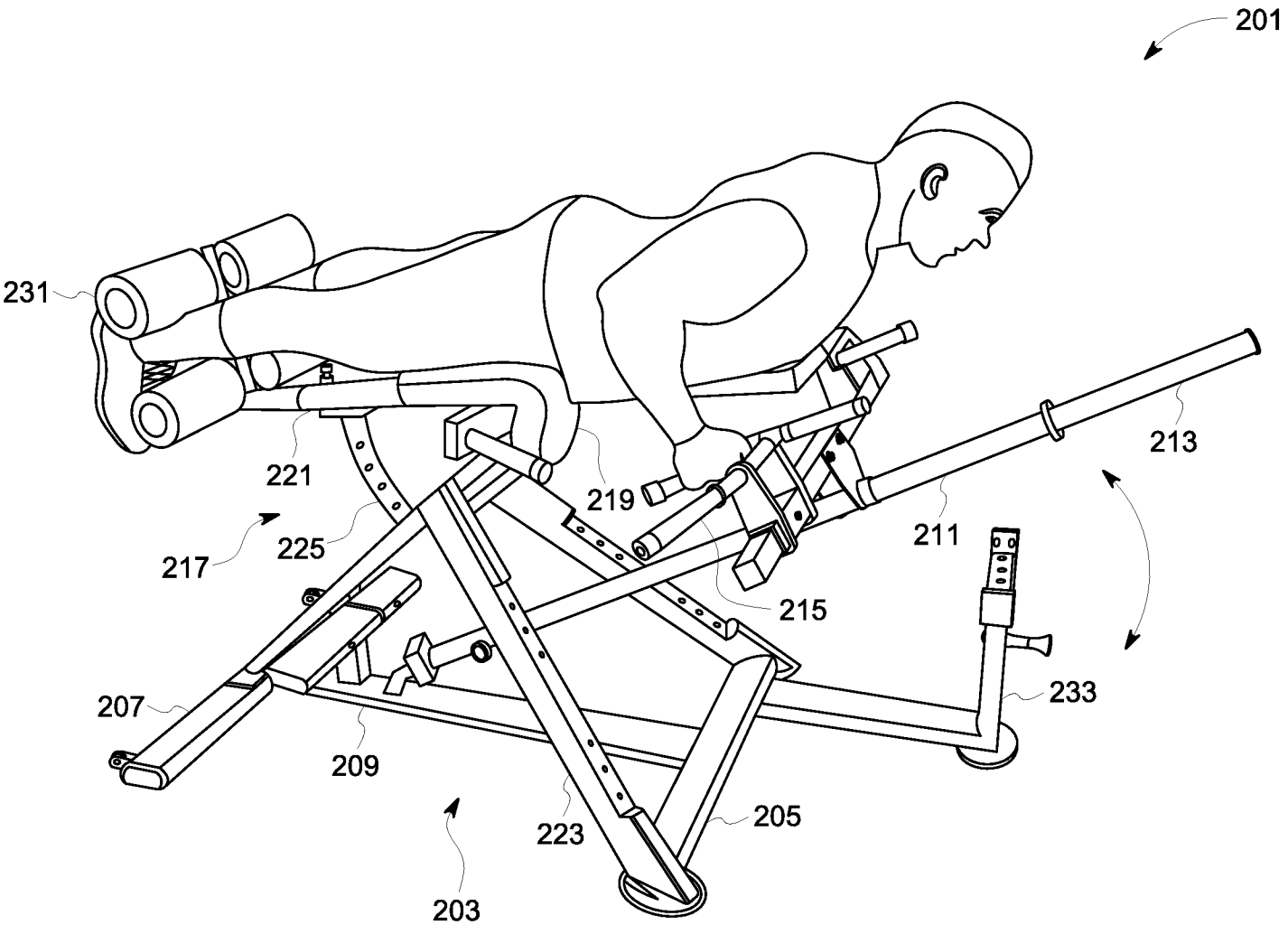
FIG. 2 is a side view of an exercise machine in accordance with the preferred embodiment of the present application.
Figure 3:
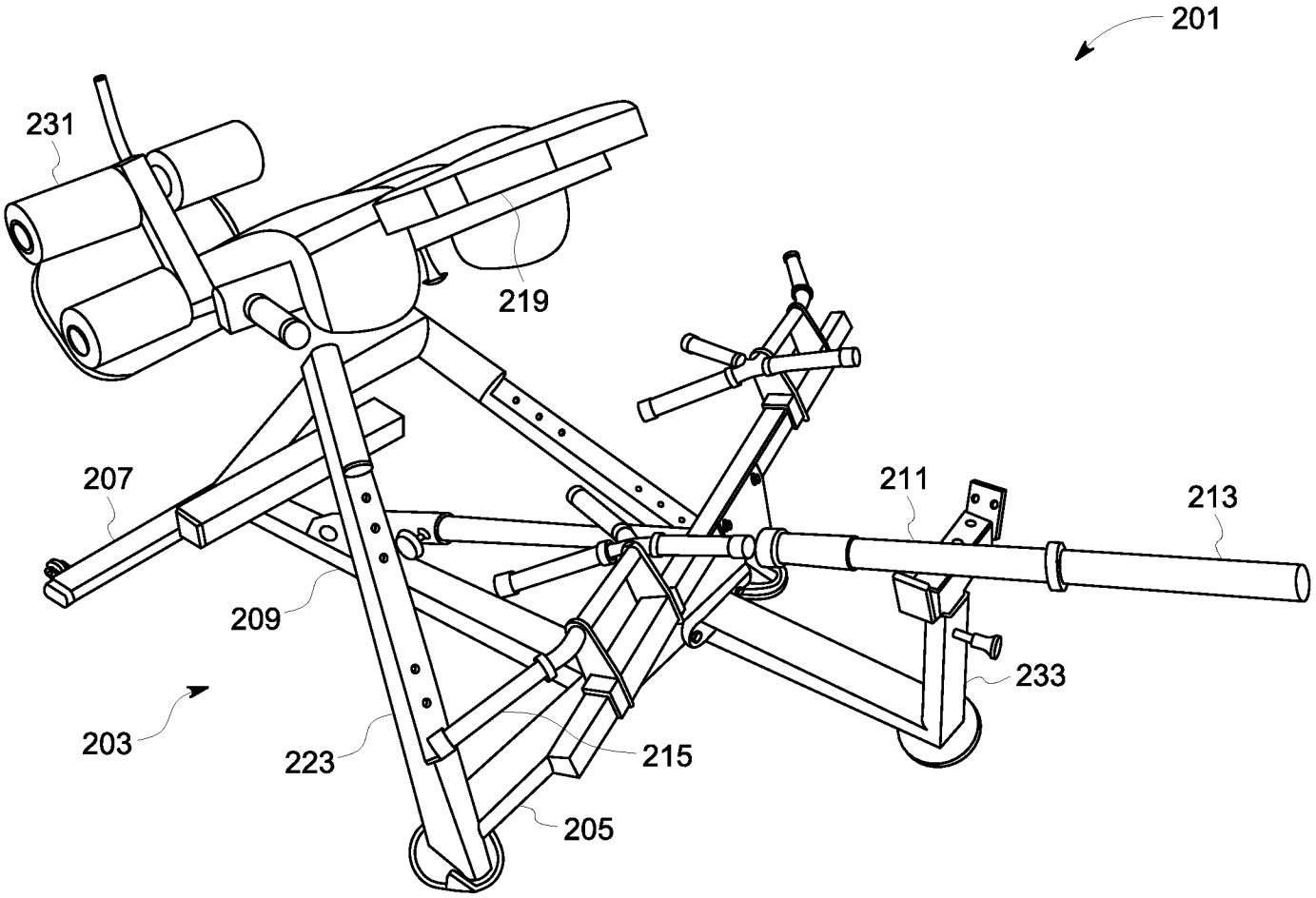
FIG. 3 is an isometric view of the machine of FIG. 2.

Referring now to the drawings wherein like reference characters identify corresponding or similar elements throughout the several views, FIGS. 2 and 3 depict views of an exercise machine system 201 in accordance with a preferred embodiment of the present application. It will be appreciated that system 201 overcomes one or more of the above-listed problems commonly associated with conventional exercise machine systems.

In the contemplated embodiment, system 201 includes a frame 203 having a front bar 205 and a back bar 207 with a cross bar 209 extending therebetween. In the preferred embodiment, a weight attachment bar 211 is pivotally attached to the cross bar 209, the weight attachment bar extending to a weight end 213 wherein the user can add their desired weight amount. In the preferred embodiment, one or more handles 215 are attached to the weight bar 211. As shown, it is contemplated that the handle arrangement can include handles extending at various angles away from a central point. This allows for various gripping locations as needed by the user. During use, the user pulls the one or more handles upward to raise the weight bar.

System 201 further includes a body support 217 positioned above the frame, the body support having one or more pads 219 attached to one or more bars 221 to allow for supporting a person thereon. In some embodiments, the body support 217 is attached to a triangular frame 223 and includes an adjustment 225 to allow for tilting the body support as needed. As shown, the system can include a leg support 227 which can further include additional pads 231.

System 201 further includes an adjustable rest 233 attached to the frame, the adjustable rest configured to support the weight end of the weight attachment bar.

It should be appreciated that one of the unique features believed characteristic of the present application is the configuration of the machine that allows for the machine to be used for a plurality of exercises, namely one or more of hyper extension, chest supported T-bar rows, bent over chest supported T-bar rows, chest supported barbell rows, bent over chest supported barbell rows, chest supported dumbbell rows, bent over chest supported dumb bell rows, and seal rows. It should be appreciated that these plurality of exercises are all completed on one piece of equipment.

Figure 4:
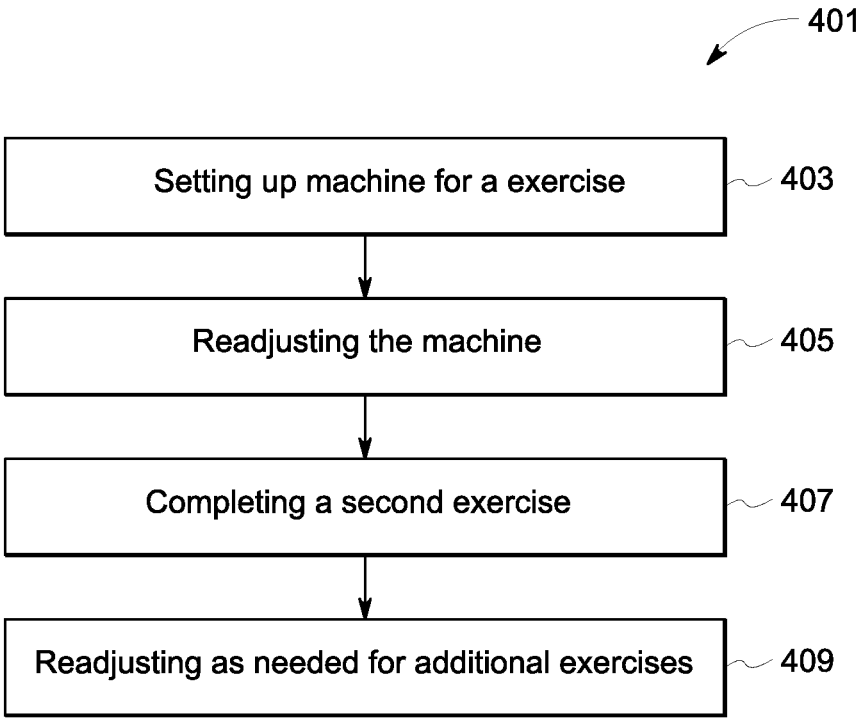
FIG. 4 is a flowchart of the method of use of the system of FIG. 2.

In FIG. 4, a flowchart 401 depicts a method of use of system 201. During use, the user will adjust the machine as needed for a particular exercise, as shown with box 403. Upon completion of the first exercise, they will readjust and continue with a second exercise, as shown with boxes 405, 407. The user will continue this process as desired, as shown with box 409.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An exercise machine system, comprising:

a frame having a front bar and a back bar with a cross bar extending therebetween;

a weight attachment bar pivotally attached to the cross bar via a pivot joint secured to the cross bar, the weight attachment bar extending to a weight end;

one or more handles attached to the weight bar and configured to provide a gripping location to provide upward movement of the weight bar;

a body support positioned above the frame, the body support having one or more pads to allow for supporting a person thereon, the body support is pivotally attached to the frame and is positioned over the pivot joint;

a leg support secured directly to the body support; and an adjustable weight attachment rest attached to the front bar and positioned in front of the body support;

wherein the weight attachment bar is positioned under the body support such that a user can pull up on the weight attachment bar from the body support.

2. The system of claim 1, further comprising:

a triangular frame attached to the frame and extending to the body support; and an adjustment attached to the body support to allow pivoting of the body support.

* * * * *